US005533542A

United States Patent [19]

Haager

[11] Patent Number: 5,533,542

[45] Date of Patent: Jul. 9, 1996

[54] DEVICE FOR CAMOUFLAGING MILITARY EQUIPMENT

[76] Inventor: Volker Haager, Ramperstorffergasse 46, A-1050 Vienna, Austria

[21] Appl. No.: 211,733

[22] PCT Filed: Sep. 28, 1992

[86] PCT No.: PCT/AT92/00122

§ 371 Date: Apr. 11, 1994

§ 102(e) Date: Apr. 11, 1994

[87] PCT Pub. No.: WO93/08440

PCT Pub. Date: Apr. 29, 1993

[30] Foreign Application Priority Data

Oct. 18, 1991 [AT] Austria ..... 2082/91

[51] Int. Cl.[6] ..... E04H 15/40

[52] U.S. Cl. ..... 135/125; 135/135; 135/153

[58] Field of Search ..... 135/124–130, 135/135, 136, 137, 147, 143, 151, 153, 95, 97; 52/81.3

[56] References Cited

U.S. PATENT DOCUMENTS

| | | | |
|---|---|---|---|
| 1,079,757 | 11/1913 | Gould | 135/126 |
| 2,547,770 | 4/1951 | Pelton | 135/126 |
| 3,837,378 | 6/1973 | Williams | 135/126 X |
| 3,929,146 | 12/1975 | Maiken | 135/126 X |
| 3,990,463 | 11/1976 | Norman | 135/126 |
| 4,998,552 | 3/1991 | Niksic et al. | 52/81.3 X |
| 5,238,015 | 8/1993 | Gretzmacher et al. . | |
| 5,285,804 | 2/1994 | Gretzmacher | 135/95 X |

FOREIGN PATENT DOCUMENTS

| | | | |
|---|---|---|---|
| 0401398 | 12/1990 | European Pat. Off. | 135/125 |

*Primary Examiner*—Lanna Mai

[57] ABSTRACT

A camouflage device for military equipment has a disk-shaped connecting element supported on elongated plastically deformable lugs which can be bent inwardly or outwardly to input different appearances to the support structure which is covered by one or more camouflage nets. When different camouflage nets are provided on opposite sides of the support structure, the variation and appearance can be further increased.

8 Claims, 3 Drawing Sheets

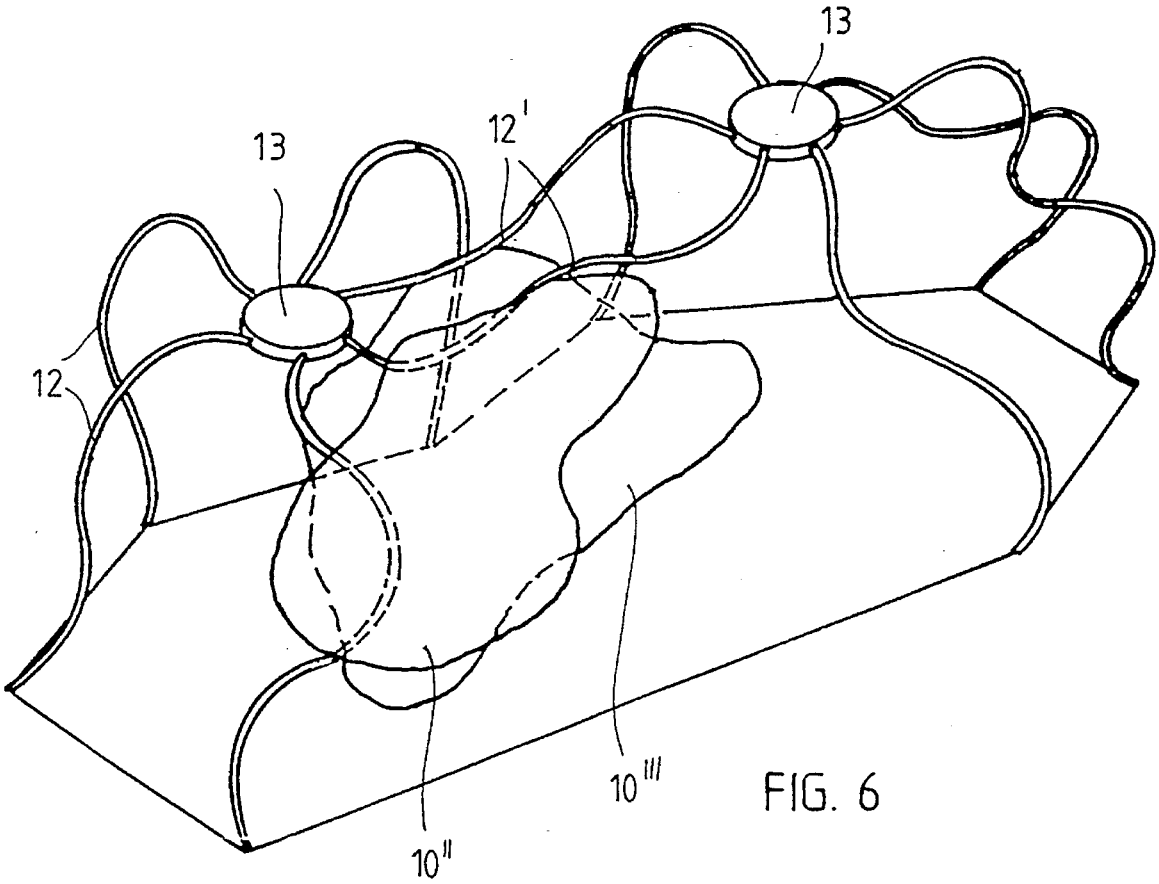
FIG. 6
FIG. 7
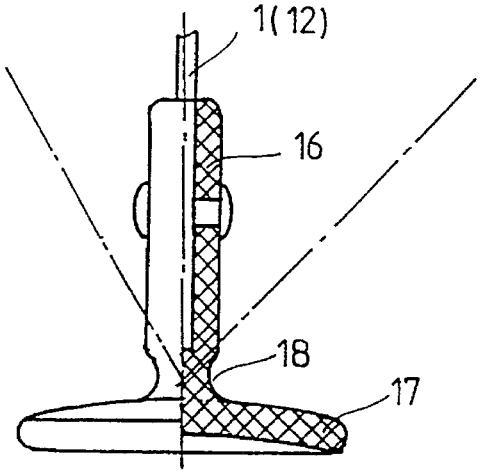

DEVICE FOR CAMOUFLAGING MILITARY EQUIPMENT

FIELD OF THE INVENTION

My present invention relates to a device for camouflaging military equipment, consisting of a rack with several supporting lugs carrying a camouflaging net or the like, with the upper ends of at least several supporting lugs being linked to each other.

BACKGROUND OF THE INVENTION

In a device of this type described in WO 90/15301, deformable bars or lugs are linked to each other at one common point, thus forming a rack. The deformability of the supporting lugs is due to the fact that they consist of link elements which may be arranged in various positions.

Both the connection of the upper ends of the bars or supporting lugs in one common point and the composition of the bars or supporting lugs in the form of basically rigid link elements entail a very limited degree of deformability of the rack and thus of the camouflaging device.

U.S. Pat. No. 4,441,518 describes a camouflaging device having elastic lugs which open and fold like an umbrella. A camouflaging net can then be placed upon several of these "umbrella-type racks". The racks cannot be substantially deformed to achieve another shape of the camouflaging device.

OBJECTS OF THE INVENTION

It is the object of the invention to provide a device of the abovementioned type which in the simplest possible way is suitable for camouflaging in various types of terrains and/or seasons.

SUMMARY OF THE INVENTION

This object is achieved by an embodiment of the invention in which the supporting lugs are plastically deformable while their upper ends are linked to each other via a disc-shaped connecting element, and in which the end of the plastically deformable supporting lugs which face the connecting element can be folded towards both sides of the connecting element.

By deforming the lugs in one direction and then again in the other direction, different appearances are created, in particular if the two sides of the camouflaging net or similar are styled differently.

This different styling of the camouflaging net may be principally achieved by having the two sides of the camouflaging net or similar done in different shapes. However, to cover the lugs in two different positions of the device, it is advantageous to cover the lugs with a camouflaging net on both sides and to use two different-looking camouflaging nets.

In another embodiment of the invention the supporting lugs are elastically deformable and linked to each other by mean of a disc-type connecting element; the supporting lugs are elastically deformable and linked to each other by means of a disc-type connecting element; the upper ends of the supporting lugs are linked by a joint to one side of the disc-type connecting element; the ends facing the connecting element are linked to each other by means of ropes; and the ends of the elastically deformable supporting lugs which face the connecting element can be folded towards both sides of the connecting element.

As a result, the device changes its shape of necessity whenever it is turned around, i.e. whenever the lugs are folded towards the other side of the disc-shaped connecting element.

To protect against the automatic folding of the device, it is advantageous to have at least one traction rope, which at one end is fastened to a lug, acting on the connecting element opposite the joints. This traction rope should be elastic.

A particularly irregular shape is achieved for both positions of the device if the lugs are of different length.

According to the invention, the surface or equipment to be camouflaged may be enlarged in a simple manner by installing at least two disc-shaped connecting elements equipped with elastically or plastically deformable lugs and by having at least one lug linked to both connecting elements.

An embodiment of the invention which has proved especially advantageous in connection with plastically deformable lugs has a disc-shaped connecting element equipped with lateral apertures into which the lugs are inserted.

To ensure a reliable fit of the device to the equipment to be camouflaged, the ends of at least some of the lugs are equipped with stems having a constriction so that the sucker can be tilted on the stem. To make sure that a gunner will have sufficient visibility of the outside or open terrain, the camouflaging net or similar may be equipped with apertures which can be closed.

BRIEF DESCRIPTION OF THE DRAWING

The above and other objects, features, and advantages will become more readily apparent from the following description, reference being made to the accompanying drawing in which:

FIG. 6 is a perspective view which shows a device with plastically deformable lugs and two connecting elements; and FIG. 7 is partially an elevation and partially a cross-section of a lug according to the invention.

SPECIFIC DESCRIPTION

Figure 1:
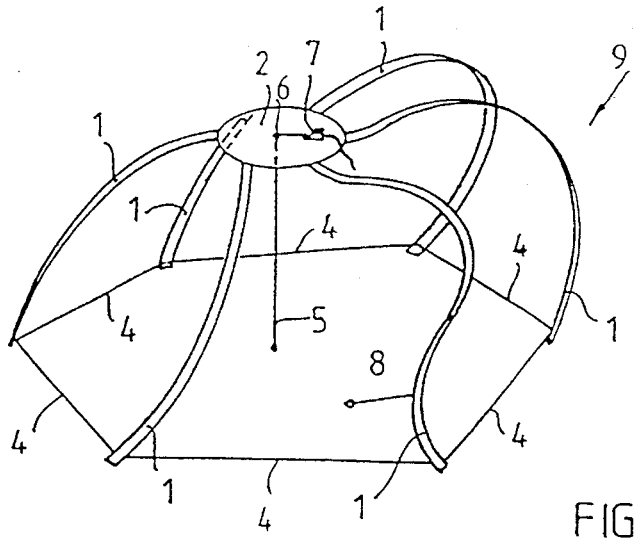
FIG. 1 is a perspective view of a device according to the invention with elastically deformable lugs without a camouflaging net.
Figure 2:
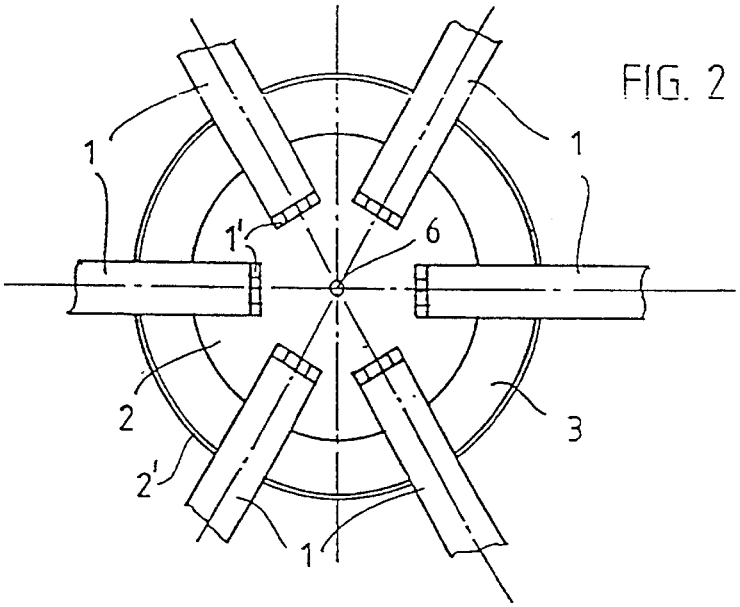
FIG. 2 is a bottom view of the connecting point of the individual lugs according to FIG. 1 drawn to an enlarged scale.
Figure 3:
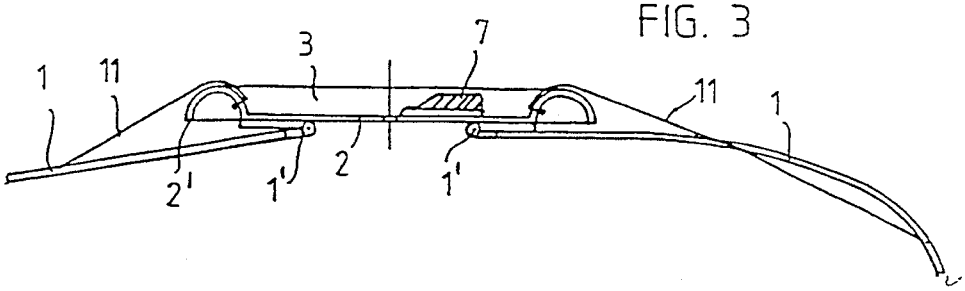
FIG. 3 is a cross-section of the connecting point according to FIG. 2.

According to FIGS. 1 to 3, elastically deformable lugs or legs 2, which are characterized by an even cross-section in the example shown, are provided. The upper ends of these lugs 1 are secured to one side of a disc-shaped connecting element 2 by means of joints 1', which disc-shaped connecting element 2 is equipped with a wraparound reinforcement bead 3 which, however, is not absolutely necessary.

The ends of the lugs 1 facing the connecting element 2 are linked to each other by means of ropes 4 and equipped with securing devices (not shown in the drawings), such as e.g. spikes, hooks, suckers etc., which help to link the lugs 1 to the ground or the piece of equipment to be camouflaged. A traction rope 5 leads from the ground (or piece of equipment) through an aperture 6 of the connecting element 2 upward to a clamp 7, which holds it. This clamp 7 could be a lever clamp of the type used to secure the lines of sailing boats.

Another traction rope 8 is pulled tight between the right lug 1 (the front lug in the drawing) and the ground (or piece of equipment).

As shown in FIG. 1, the flexibility of the arms 1 and the stretched taction ropes 5 and 8 create an irregular object 9, a dummy object which provides excellent camouflage if covered by a camouflaging net or similar in this the shape of this object 9 may be changed easily. For this, is it sufficient to alter the effective length of the traction rope 5 or 8; the shape is also changed if a lug 1 is pulled either inward or outward when the traction rope 5 is tightened. In addition, the irregular shape of the object 9 is even increased by the fact that the lugs 1 are of different length.

Figure 4:
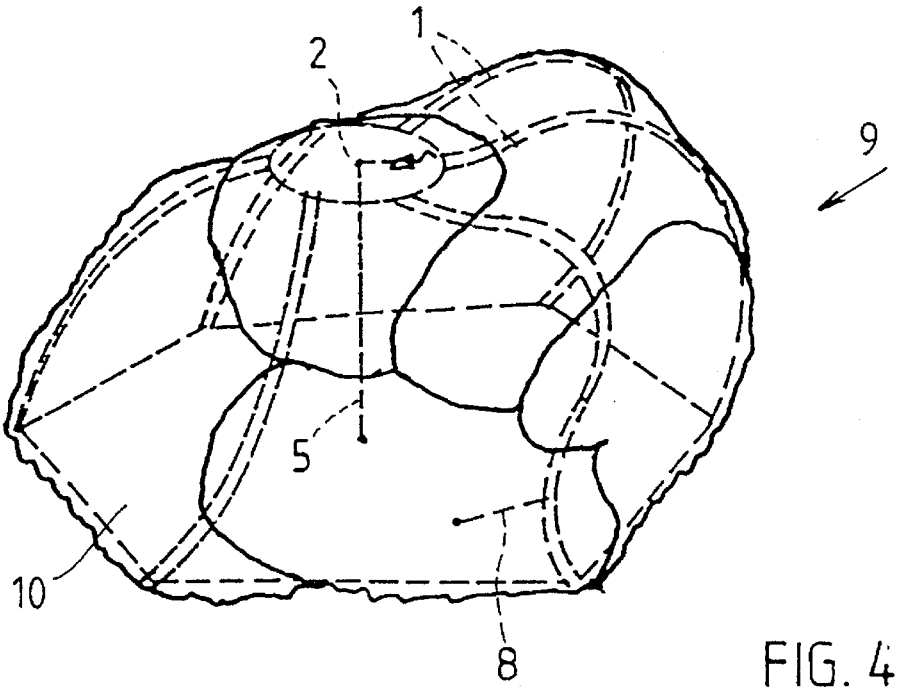
FIG. 4 is a perspective view of the device represented in FIG. 1 covered by a camouflaging net.

If an object 9 is covered by a camouflaging net 10, the result is a visual outlook roughly represented in FIG. 4.

Figure 5:
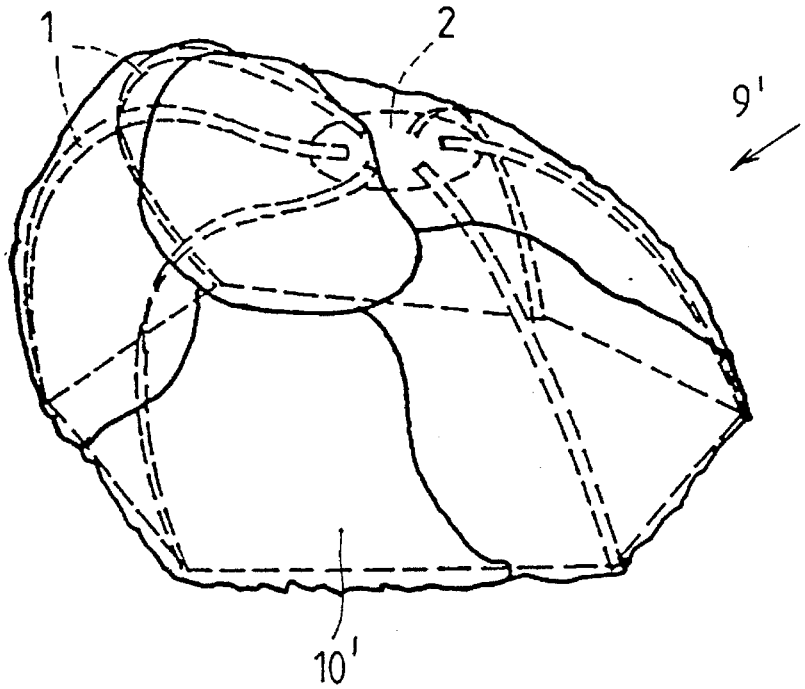
FIG. 5 is a view similar to FIG. 4 with this device turned the other way around.

However, the lugs 1 may not only be deformed towards the joints 1' (inwardly) but also in the other direction (i.e. outwardly). Since in this case they must be bent over the edge 2' of the connecting element 2, the result will at any rate be a different outlook for the object thus created. FIG. 5 shows such an object 9' which stands of its own and thus requires no traction ropes 5, 8.

However, deforming the lugs 1 in the other direction will change, not only the shape of the object, but also its outlook, e.g. by covering the lugs 1 on the side facing the camouflaging net 10 with a different-looking camouflaging net 1O'. For example, this makes it possible to use the device for winter/summer camouflage or field/desert camouflage etc.

FIG. 3 shows elastic traction ropes 11 secured at one end to the side of the connecting element 2 facing the joints 1', while the other end of each traction rope 11 is fastened to one lug 1. When the lugs 1 are automatically inwards so that they will open of their own accord.

In the embodiment according to FIG. 6, plastically deformable lugs 12 are inserted into lateral apertures of disc-shaped connecting elements 13 and secured to them, e.g. by means of friction, gluing or welding. The lugs may be made of e.g. synthetic material or coiled wire.

In the example shown, two connecting elements 13 are present, and two lugs 12' are linked to both of the two connecting elements 13. This creates a larger camouflage zone, in which the two arms 12' are again deformable towards the two sides of the connecting elements 13, i.e. they may be bent upward (with respect to FIG. 6) as well, in which case the entire device is set up the other way around. If the camouflaging net or nets looks or look different on both sides of the lugs 12, this will result, not only in a different shape, but also in a different outlook of the device. For the sake of greater clarity, FIG. 6 shows only parts of the camouflaging nets or similar, namely the part 10" facing the observer as well as the inner part 10'''.

As a result of the manifold possibilities of application of a device according to the invention, the way the ends of the lugs 1 and 12 are secured to the various elements should also be adaptable. This is achieved by means of a sucker according to FIG. 7, whose stem 16 is characterized by a constriction 18 at the point of transition to the sucker plate 17. This makes it possible to tilt the stem 16 and thus the lugs 1 and 12 vis-a-vis the sucker plate 17 stuck to the device, as shown by the center lines in the drawing.

I claim:

1. A camouflage device for military equipment, comprising:

a disk-shaped connecting element adapted to be disposed above said equipment;

a multiplicity of elongated supporting lugs, each of said lugs having an upper end connected to said connecting element and a lower end, said supporting lugs being plastically deformable so as to be bent selectively inwardly and outwardly; and different camouflage nets secured to opposite sides of said connecting element and to said supporting lugs to impart different appearances to said device depending upon which of said camouflage nets is visible.

2. The camouflage device defined in claim 1 wherein at least one traction rope is secured at one end of said traction rope to said connecting element and at an opposite end of said traction rope to at least one of said lugs.

3. The camouflage device defined in claim 2 wherein said traction rope is elastic.

4. The camouflage device defined in claim 2 wherein said lower ends of said lugs are provided with suction plates connected by stems to said lugs, said stems being formed with constrictions enabling tilting of the suction plates on said stems.

5. A camouflage device for military equipment, comprising:

a disk-shaped connecting element adapted to be disposed above said equipment;

a multiplicity of elongated supporting lugs, each of said lugs having an upper end connected to said connecting element at respective joints and a lower end, said supporting lugs being plastically deformable so as to be bent selectively inwardly and outwardly;

a camouflage net on said connecting element and to said supporting lugs; and at least one traction rope secured at one end of said traction rope to said connecting element opposite a respective one of said joints and at an opposite end of said traction rope to said lug having the respective one of said joints.

6. The camouflage device defined in claim 5 wherein said traction rope is elastic.

7. The camouflage device defined in claim 6 wherein said lower ends of said lugs are provided with suction plates connected by stems to said lugs, said stems being formed with constrictions enabling tilting of the suction plates on said stems.

8. A camouflage device for military equipment, comprising:

a disk-shaped connecting element adapted to be disposed above said equipment;

a multiplicity of elongated supporting lugs, each of said lugs having an upper end connected to said connecting element and a lower end, said supporting lugs being plastically deformable so as to be bent selectively inwardly and outwardly;

at least one camouflage net secured to said connecting element and to said supporting lugs; and suction plates connected by stems to said lugs at said lower ends, said stems being formed with constrictions enabling tilting of the suction plates on said stems.

* * * * *